US006070498A

United States Patent [19]

Mislich et al.

[11] Patent Number: 6,070,498

[45] Date of Patent: Jun. 6, 2000

[54] SHINGLE REMOVING TOOL

[76] Inventors: Jay Mislich, 508 N. Locust, Pontiac, Ill. 61764; Thomas Mislich, Jr., 503 E. Praire, Odell, Ill. 60460

[21] Appl. No.: 09/153,622

[22] Filed: Sep. 15, 1998

[51] Int. Cl.[7] ..... E04D 15/00

[52] U.S. Cl. ..... 81/45; 254/131.5; 30/169

[58] Field of Search ..... 81/45; 30/172, 30/47; 294/52; 254/131.5, 132, 131; 299/41.1

[56] References Cited

U.S. PATENT DOCUMENTS

| | | | |
|---|---|---|---|
| 1,235,208 | 7/1917 | Lawson | 254/131.5 |
| 4,009,743 | 3/1977 | Ackerman . | |
| 4,086,699 | 5/1978 | Olkkola . | |
| 4,182,390 | 1/1980 | Renner . | |
| 4,663,995 | 5/1987 | Amundson et al. | 81/45 |
| 5,001,946 | 3/1991 | Shirlin et al. | 81/45 |
| 5,076,119 | 12/1991 | Wenz . | |
| 5,134,907 | 8/1992 | Branson | 81/46 |
| 5,207,126 | 5/1993 | Schaben . | |
| 5,280,676 | 1/1994 | Fieni . | |
| 5,495,781 | 3/1996 | Wirth . | |
| 5,527,077 | 6/1996 | Bickar . | |
| 5,836,222 | 11/1998 | Harpell | 81/45 |
| 5,893,304 | 4/1999 | Carroll | 81/45 |
| 5,906,145 | 5/1999 | Shepherd | 81/45 |

*Primary Examiner*—David A. Scherbel
*Assistant Examiner*—Lee Wilson
*Attorney, Agent, or Firm*—Knechtel, Demeur & Samlan

[57] ABSTRACT

A tool for removing shingles and nails from a roof in which the tool has a base mounting plate which has a plurality of forwardly extending tines. The tines are adapted for pushing under the shingles. The tines pry the shingles loose from the roof. A plurality of forwardly extending teeth are positioned on the base plate below and rearward of the tines. The teeth remove nails remaining on the roof after the shingles are removed. Both the tines and teeth operate when the tool is pushed in a forwardly shingle removing direction.

15 Claims, 2 Drawing Sheets

SHINGLE REMOVING TOOL

I. BACKGROUND AND SUMMARY OF THE INVENTION

This invention relates to hand tools and more particularly to a hand tool used for removing shingles and nails from a roof.

Houses are generally constructed having inclined roofs which are covered with a plurality of overlapping, horizontally aligned rows of shingles. The shingles may be made of asphalt or wood which are nailed to the roof. Generally, beginning with the bottom or lower-most edge of the roof, the shingles are nailed in place with successive layers or rows overlapping the top of the proceeding below-mounted row. The shingles are generally mounted to the roof by a plurality of nails.

Over time, the shingles deteriorate and will leak. Thus, it is necessary to periodically remove the shingles in order to apply a new roof covering. In order to remove the shingles, it is necessary to pry up the shingles and nails. This is done in the reverse order as when the shingles were installed. At times, the shingles will pull the nails up with them when they are removed and other times, the nails remain in the roof and must be extracted separately.

Various tools have been used in the past to accomplish these purposes. Examples of such patents are as follows: U.S. Pat. No. 5,495,781 issued to Wirth on May 5, 1996 discloses a prying tool that fits into gaps between the skip sheeting boards. This device does not have tines which are forced under the shingles in order to assist in removing them, nor does it have any mechanism to lift the nails from the roof by a tooth or claw mechanism.

U.S. Pat. No. 5,207,126 issued to Schaben on May 4, 1993 discloses a shake removal tool. This device does not have tines or teeth to assist in lifting the shingles and essentially provides only a mechanism used to remove nails from the roof.

U.S. Pat. No. 4,182,390 issued to Renner on Jan. 8, 1980 discloses a roof shingle remover tool that is swung by the roofer under the shingles in order to remove the shingles.

U.S. Pat. No. 5,001,946 issued to Shirlin et al. on May 26, 1991 illustrates an air cylinder mechanism in conjunction with a lever mechanism used to remove shingles.

U.S. Pat. No. 5,527,077 issued to Bickar on Jun. 18, 1996 shows a rake attachment for converting a pitchfork into a combination device. This invention is not readily adaptable to remove nails from a roof.

U.S. Pat. No. 4,009,743 to Ackerman on Mar. 1, 1997 illustrates a roof stripping tool in which the forward end of the tool has teeth that can cut the nails or, alternatively, the nails are received between the teeth and can be removed.

U.S. Pat. No. 5,280,676 issued to Fieni on Jan. 25, 1994 illustrates a tool used to remove shingles and nails from the roof on both a forward or backward stroke. There are teeth with openings at the forward end to receive the nails on a forward pushing stroke and teeth facing in the opposite direction at the rear of the tool to receive nails on a withdrawing or backward stroke.

A common problem with all of the prior art devices is that they do not provide long extending tines which are easy to slip under shingles and provide the leverage required to lift the shingles easily. By using long protruding tines, Applicant has provided a hand tool which easily slides under the shingles. Furthermore, a problem with the prior devices is that the nail removing teeth are generally provided on the same initial cutting blade surface which is used to be pushed underneath the shingles. This results in the teeth striking the nail heads and often snapping them off. Furthermore, the teeth, as being a portion of the forward-most edge of the blade, quickly dull or themselves can be broken. Applicant's device overcomes this problem by providing a separate set of teeth positioned rearwardly of the forward pointed tines. This allows the tines to separately lift the shingles and, at times, the nails, holding the shingles in place, are also removed. The nail removing portion of Applicant's device is only utilized once the shingles are removed and any nails remain in the roof.

Accordingly, Applicant's invention provides a shingle removing tool that has sharp forwardly projecting tines located at one end of a handle. The tines have pointed tips which easily slide underneath the shingles and can be used to pry the shingles from the roof. Disposed rearwardly of the tines and pointing in the same direction as the pointed tips of the tines are a plurality of teeth extending in the same direction as the tines. These rearwardly disposed teeth will engage and remove any nails remaining in the roof after the tines have lifted the shingles from the roof. Furthermore, the rearward teeth engage the nails as the tool is pushed forward in a constant forward moving direction without requiring or necessitating the removal of nails on a backward stroke of the tool.

II. OBJECTS AND ADVANTAGES OF THE INVENTION

Thus, it is an object of the Applicant's device to provide a shingle removing tool constructed in such a way that it has forward extending tines which slip beneath the shingles with a minimum of resistance. It is a related object of the invention to use the elongated tines as a prying mechanism to lift the shingles from the roof.

Another object of the invention is the object of providing a shingle removing tool that has rearwardly positioned teeth to engage nails remaining in the roof after the tines lift the shingles from the roof. Related to this object is the object of providing a plurality of rearwardly disposed teeth which remove nails remaining in the roof as the tool is pushed in a forward shingle removing direction which causes the teeth to engage any remaining roof nails.

Yet another related object is the object of removing as many shingles and their fastening nails together. An advantage is that this minimizes the necessity of a second step of removing remaining nails by means of a separate tool.

III. BRIEF DESCRIPTION OF THE DRAWINGS

FIG. 1 is a top plan view with portions removed of the inventive shingle removing tool.

FIG. 2 tool is a bottom view of the shingle removing tool with portions removed.

VI. DESCRIPTION OF THE PREFERRED EMBODIMENT

Figure 1:
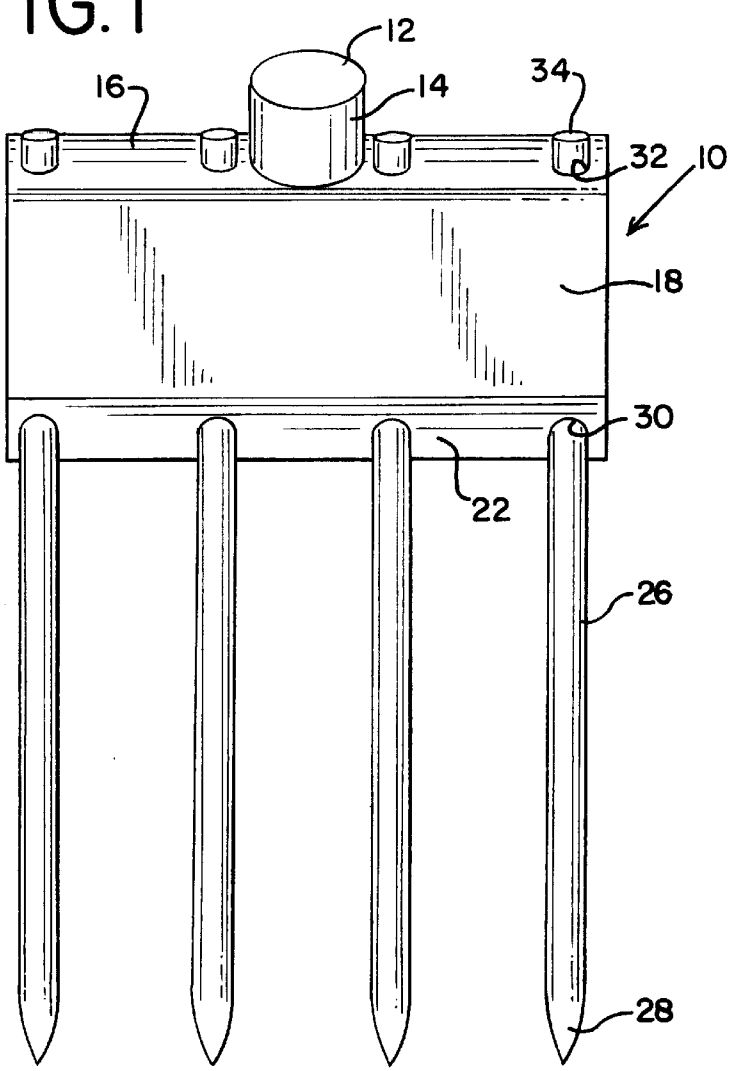

Turning first to FIG. 1, there is illustrated an inventive shingle removing tool 10 of the present invention. There is an elongated handle 12 which has its distal end grasped by the user. A forward end 14 is inserted into a tubular collar 20 which passes through a back wall 16 and of a base plate 18.

Figure 2:
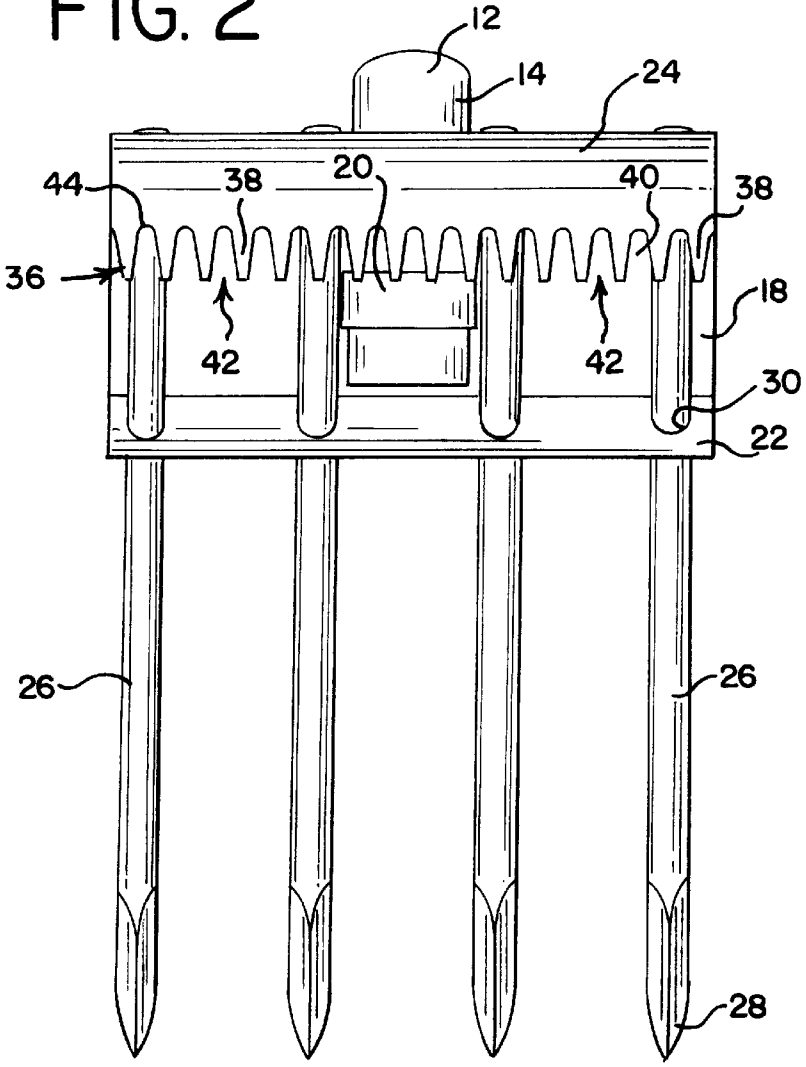

As seen in FIG. 2, which is the bottom view of the tool 10, the collar 20 passes through and is affixed to the underside of the base plate 18. Generally, the collar 20 will be welded to the base plate 18 but any other means by which the collar 20 can be firmly and fixedly attached to the base plate 18 will be apparent to those skilled in the art of metal forming and fastening. The forward end of the handle 14 is firmly received within the collar 20 by either a friction fit, or a fastener passing through the collar 20 and into the forward end 14. Furthermore, a combination of both a friction fit and fastener could also be utilized.

Figure 3:
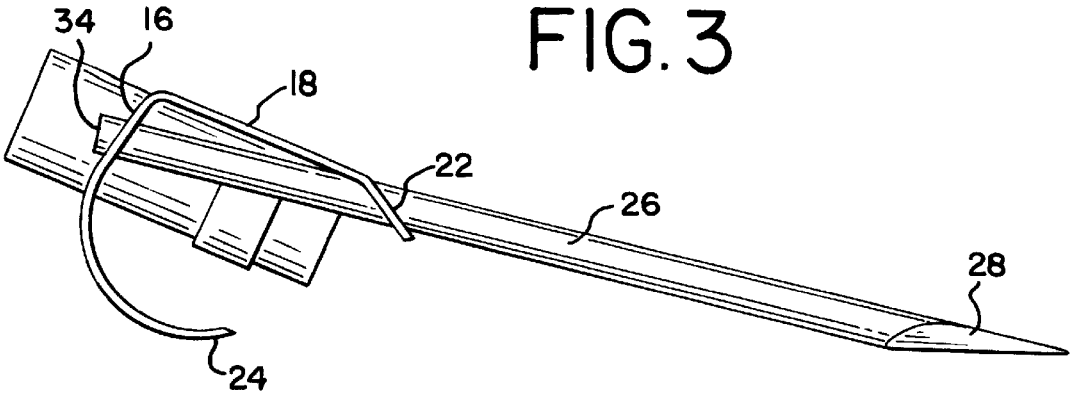
FIG. 3 is a side view of the shingle removing tool with portions removed.

As can be seen in FIG. 3, the base plate 18 is formed in a U or C-shaped cross-section. There is a front portion 22, the back wall 16, and a rear portion 24. A top portion 19 presents a substantially solid plate surface to the user. There are a plurality of elongated tines 26 (which in the preferred embodiment, four are illustrated) which extend forward from the base plate 18. The tines terminate at pointed tips 28. The tines 26 are retained within the base plate 18 so that as they are slipped under shingles 29 and used to lift the shingles from the roof, they will remain fixed within the base plate 18. This is accomplished by the tines passing through a front slot 30 located in the front portion 22 of the base plate 18. The tines then pass through a rear slot 32 at the back wall 16 of the base plate 18. A rear end of the tine 34 extends slightly beyond the back wall 16. The tines can be dimensioned to be very closely received within the front and rear slots 30, 32, so that a very tight frictional engagement between the slots and the tines results in the tines being fixed within the slots. Furthermore, the tines may be further fixed by means of fasteners or welding. It is important that the tines be fixed into the base plate 18 so that they will not move with respect to the base plate 18 during the shingle removing operation.

As seen in FIG. 3, the rear portion 24 extends in a forward direction which is the same direction as the pointed tip 28 of the tine 26. However, the rear portion 24 is disposed toward the rear of the tines 26 such that the forward ends of the tines 26 extend approximately seven to nine inches beyond the rear portion 24. As seen in FIG. 2, the rear portion 24 terminates at a proximal end 36. At the proximal end 36 are a plurality of teeth 38 separated by spaces 40. At the forward end of the spaces 40 are openings 42 which are adapted to receive nails 43 remaining in the roof. The nails will slide into the opening until striking an end wall 44 at the back of the opening 42. The openings have tapered side walls such that the nail head will be directed toward the end wall 44 with the head of the nail being received at the end wall 44 such that the tool 10 can be raised up from the roof, pulling the nails retained within the openings 42 out from the roof.

Figure 4:
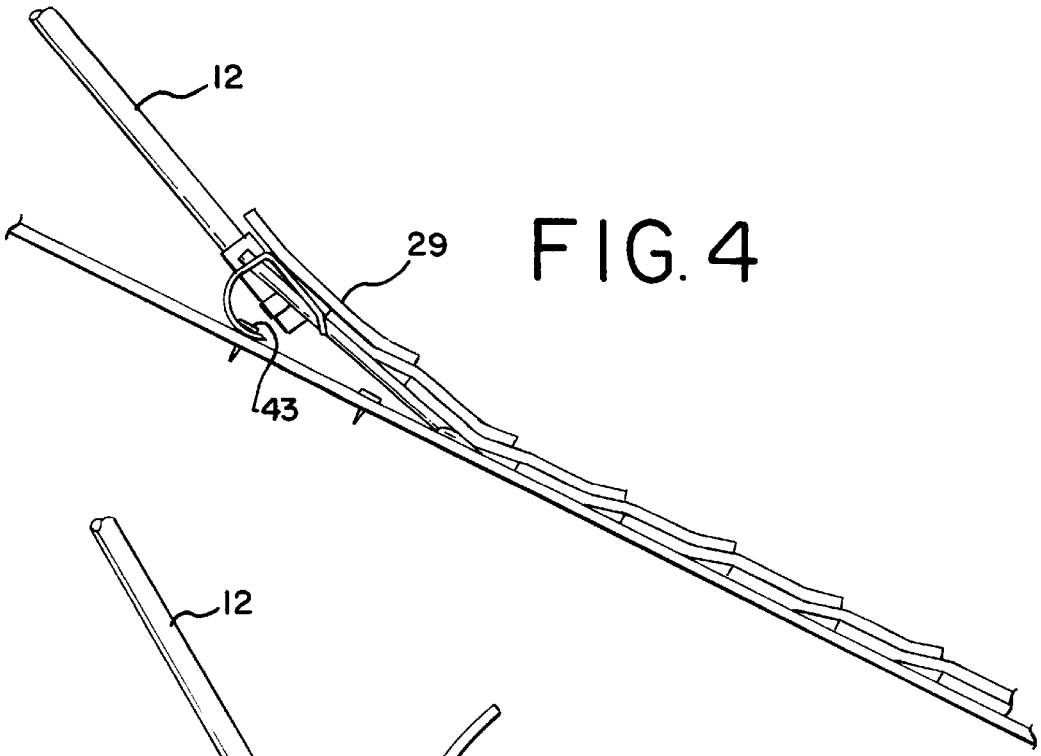
FIG. 4 is a side view of the tool as it lifts shingles from the roof.
Figure 5:
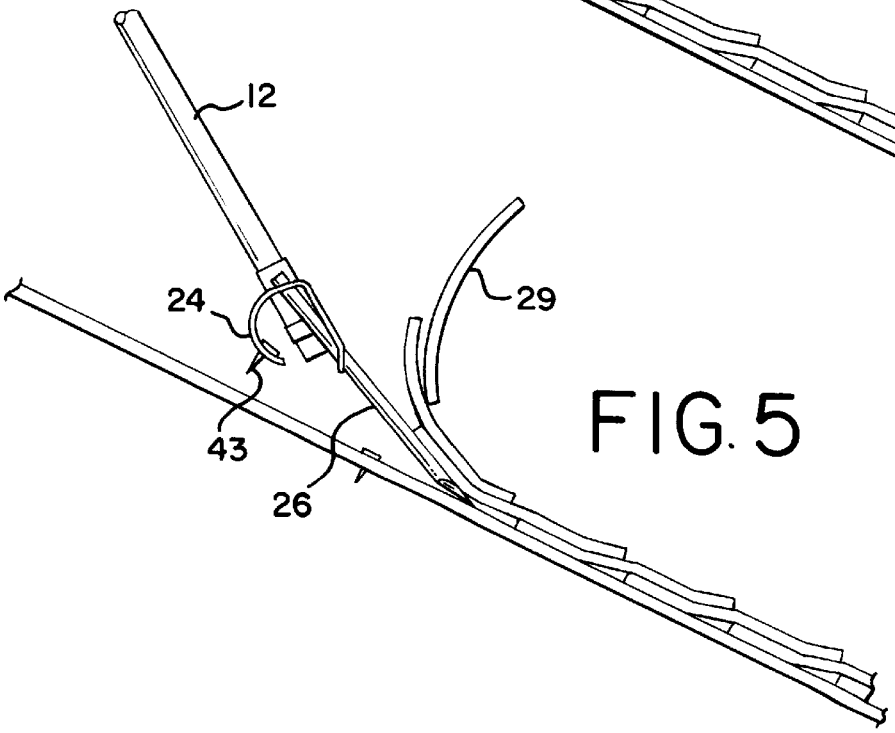
FIG. 5 is a side view of the tool as it lifts shingles from the roof and also pulls a remaining nail from the roof.

In operation, the user grasps the handle 12 and pushes the pointed tips 28 of the tines 26 under the top of a shingle 29 as illustrated in FIG. 4. The tines 26 are made of steel and, although fairly rigid, will flex slightly. The pointed tines will easily slide under the shingle 29 and with a slight upward motion on the end of the handle 12, the shingles are lifted and removed from the roof. Often the roofing nails are embedded in the shingles when the shingles are removed. However, at other times, the shingles will pull away from the nail, leaving the nail head in the roof. In this case, the proximal end 36 of the rear portion 24 is slid under the nail head such that the nail head is received in the opening 42. Once the nail head strikes the end wall 44, the handle is again lifted and the nail is pulled up and removed from the roof as seen in FIG. 5. Thus, with only a forward pushing motion, the shingles are removed and, in the same motion, the remaining nails 43 can be lifted from the roof by means of the teeth 38.

The top portion 19 of the base plate 18 acts as a shield from the nails which are pulled up as the tool 10 is pushed along. Some of the nails are thrown up toward the user and the top portion 19 functions as a safety shield. Also, the underside of the top portion 19 directs the nails down back onto the roof where they roll off into the gutter for easy collection.

While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A tool for removing shingles and nails from a roof comprising:

an elongated handle having an upper end and a lower end, the upper end adapted for grasping the tool by a user;

a base mounting plate attached to the lower end;

a plurality of slots disposed in the base mounting plate;

a plurality of tines attached to the base mounting plate, the tines being received and retained in locking engagement within the slots in the base mounting plate, one end of the tines extending away from the base mounting plate in a forward shingle removing direction, the tines adapted for inserting under an edge of the shingle for prying the shingles up from the roof;

a plurality of adjacent teeth positioned below the tines when the tines are in their operative position, the teeth separated by openings disposed between adjacent teeth, the openings oriented in the same direction as the tines, the tines extending forward of the teeth to lift up and remove shingles and the openings between the teeth engaging and pulling nails from the roof which remain after the shingles are removed.

2. The tool of claim 1 wherein the teeth have side walls which taper inwardly toward a narrow back end to engage nails for removal from the roof.

3. The tool of claim 2 wherein the teeth are mounted to the base plate.

4. The tool of claim 2 wherein the teeth are integrally formed with the base plate.

5. The tool of claim 1 wherein the base mounting plate is U-shaped in cross-section with one leg of the U-shaped plate having the tines mounted thereon and the other leg of the U-shaped plate having the plurality of teeth disposed thereon.

6. The tool of claim 5 wherein the one leg of the U-shaped plate extends forward of the other leg and presents a substantially solid surface to shield the user from nails pulled from the roof.

7. The tool of claim 1 wherein the one end of the tines are pointed to assist in inserting them under the shingles.

8. The tool of claim 1 wherein the tines extend at least seven inches beyond the plurality of teeth.

9. A tool for removing shingles and nails from a roof comprising:

a substantially U-shaped base mounting plate defining a first leg and a second leg;

a plurality of tines attached to the first leg of the base mounting plate, the tines extending away from the base mounting plate in a forward shingle removing direction;

a plurality of adjacent teeth disposed on the second leg of the base mounting plate below and rearward of the tines, the teeth separated by openings between adjacent teeth, the openings between adjacent teeth being oriented in the same direction as the tines;

a handle having one end attached to the base mounting plate and the other end adapted for grasping by a user;

the tines adapted for insertion below the shingles to lift and remove the shingles from the roof and the openings between adjacent teeth for engaging and pulling nails from the roof which remain after the shingles are removed, the first leg of the mounting plate extending forward of the teeth and presenting a substantially solid surface to shield the user from the nails pulled from the roof.

10. The tool of claim 9 wherein the teeth have side walls which taper inwardly toward a narrow back end to engage nails for removal from the roof.

11. The tool of claim 10 wherein the teeth are mounted to the base plate.

12. The tool of claim 11 wherein the teeth are integrally formed with the base plate.

13. The tool of claim 10 wherein the one end of the tines are pointed to assist in inserting them under the shingles.

14. The tool of claim 9 wherein the tines extend at least seven inches beyond the plurality of teeth.

15. The tool of claim 9 wherein the tines are received and retained in locking engagement within slots in the base mounting plate.

* * * * *